United States Patent [19]

Christie

[11] 3,970,308

[45] July 20, 1976

[54] RING, BALL AND CONE RETRIEVAL APPARATUS

[75] Inventor: Donald M. Christie, Toronto, Canada

[73] Assignee: Lawrence Peska Associates, Inc., New York, N.Y. ; a part interest

[22] Filed: Dec. 10, 1975

[21] Appl. No.: 639,253

[52] U.S. Cl. ..... 273/95 A

[51] Int. Cl.[2] ..... A63B 71/02

[58] Field of Search ..... 273/95 R, 95 A, 97 R, 273/98, 99, 100, 104, 1.5 R, 1.5 A

[56] References Cited

UNITED STATES PATENTS

| | | | |
|---|---|---|---|
| 1,705,501 | 3/1929 | Sas | 273/100 |
| 2,082,083 | 6/1937 | Swift | 273/100 |
| 2,832,597 | 4/1958 | Brennan | 273/99 |
| 3,345,772 | 10/1967 | Sam | 273/100 |

FOREIGN PATENTS OR APPLICATIONS

| | | | |
|---|---|---|---|
| 1,195,428 | 11/1959 | France | 273/1.5 A |

*Primary Examiner*—Anton O. Oechsle
*Assistant Examiner*—Marvin Siskind

[57] ABSTRACT

A toy and game set of elements in which there is a major base in the form of a hollow truncated cone with a lower brim, adapted for being held in the hand of the player and including an annular ring member which is to be normally seated on the cone body surface and to be thrown by swinging the arm or hand of the player into the air. The player also throws a ball into the air and tries to retrieve the ring member onto the cone before the ball hits the ground. A retaining string attached to the ball and held by the player keeps the ball within bounds. The game device is also called a "KESEE GAME".

2 Claims, 3 Drawing Figures

RING, BALL AND CONE RETRIEVAL APPARATUS

SUMMARY OF THE INVENTION

This invention relates to amusement game devices involving the skill and timing of the player or players.

An object of the present invention is to provide a new and novel game device in which some of the game pieces are thrown into the air serially, to be retrieved selectively by the participants.

Another object of the present invention is to provide a new and novel game of skill and timing in which there is a main base member which is held in the hand and a pair of different playing token members which are selectively cast into the air, the object being to retrieve a particular one of the token members before the other different token member hits the ground.

A further object of the present invention is to provide a new and novel game and toy game device in which there is a major game base element in the form of a truncated cone with an upturned brim portion at its lower end, including a ring member which normally sits on the cone near its brim, and which is to be tossed into the air by the player who also throws a ball into the air and is supposed to try to catch the ring with the cone before the ball hits the ground.

Still another object of the present invention is to provide a new and novel game device which can be played by more than one player in competition with each other.

Still a further object of the present invention is to provide a new and novel toy and game device which is simple in design, includes only a few parts and which can be made of readily available materials, at low cost and by hand or mass production.

BACKGROUND OF THE INVENTION

The playing of games of skill and chance have always been a source of interest on the part of most persons, young or old, and new and novel games are eagerly sought and played. The present invention is a game set which is easily understood and can be played by anyone including children both indoors and out of doors. It includes a very minimum of parts and can be assembled at low cost. Thus, there is a main element in the form of a cone with a ring member seated thereon, which is thrown into the air and it is to be retrieved on the cone before a ball which is also thrown reaches the ground.

BRIEF DESCRIPTION OF THE DRAWINGS

The above and other objects, features and advantages of the present invention will become apparent from the following description of the preferred embodiment as illustrated in the accompanying drawings, wherein.

BRIEF DESCRIPTION OF THE PREFERRED EMBODIMENT

Figure 1:
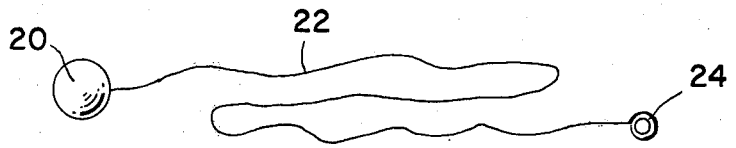
FIG. 1 is a plan view of the ball which is thrown in the game, as it is tied with a return string having a finger holder.
Figure 2:
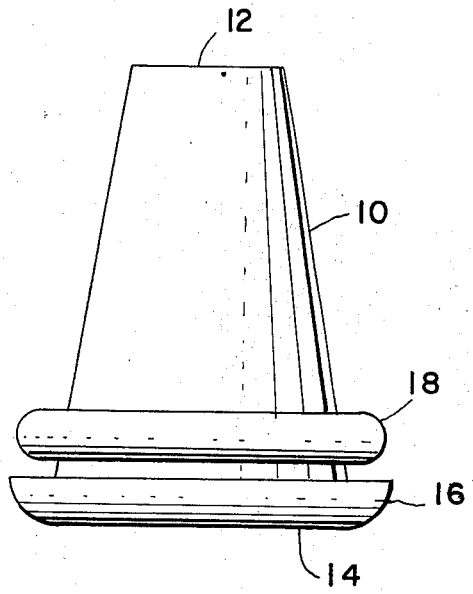
FIG. 2 is an elevational view of the cone member of the game device with the annular ring member seated thereon.

In order to understand more clearly the nature of the invention and the best means for carrying it out, reference may be had to the drawings in which like numerals denote similar parts throughout the several views.

As shown, there is a cone member 10 which is truncated at its upper end 12 and has at its lower wide end 14 an upturned brim portion 16. According to one form of the invention, the cone member 10 is hollow and made of light weight material, such as plastic, sheet metal or fibre board. The outer surface of the cone member is preferably quite smooth, so that the smooth inner surface of the annular ring member 18 is easily slidable over the cone surface where it normally remains near the brim 16 before being thrown into the air.

Figure 3:
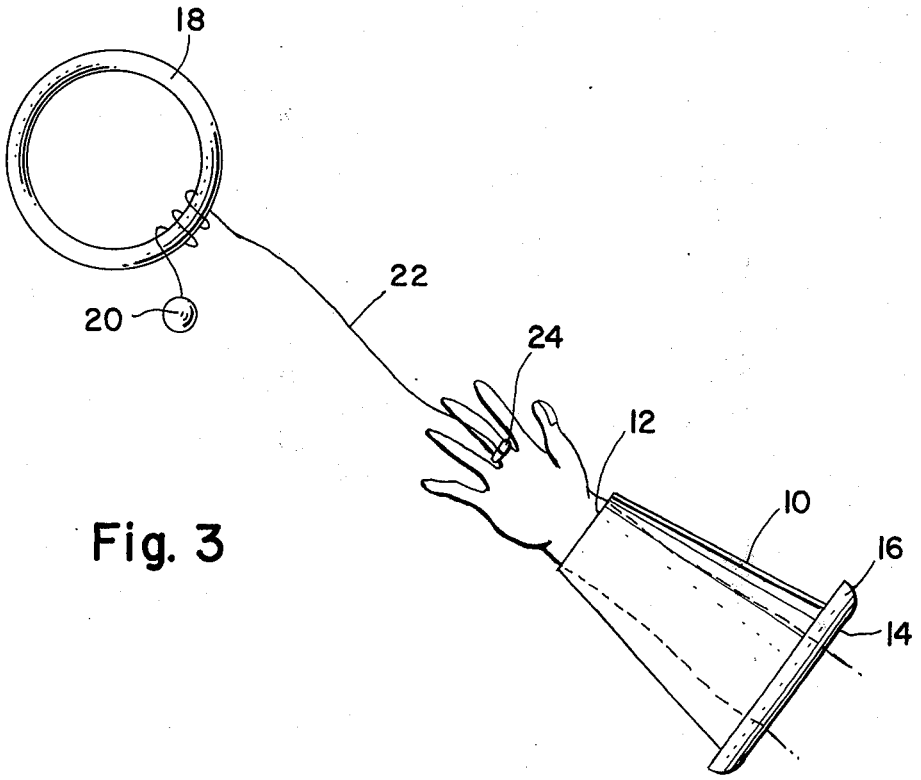
FIG. 3 is a side elevational view of one method of playing the game, showing the various cone and other elements of play.

The cone member is grasped by the hand of the player, by grasping its brim 16 and by giving a quick swing of his or her arm, which results in the ring member 18 being thrown into the air as best seen in FIG. 3. The game set includes a ball 20, attached to a retrieval retaining string 22 made of nylon or other strong cord and has a finger holder ring 24 at the other end so that the ball cannot get too far away from the players.

The player holds the ball and the cone member and with the ball held firmly in the hand, the ball is then thrown into the air with the aim of returning the ring to its place on the cone before the ball hits the ground. The string may be about four feet long and the ball need not be heavy. However, the annular ring member 18 should be made of very light weight plastic material which would give the sensation and appearance of sort of floating through the air.

The game is such that it can be played singly or with more than one player, in which one would try to retrieve his partner's ring. With more than two players, you try to retrieve your own and as many others as possible. As shown in FIG. 3, the hand may be thrust through the hollow cone member, to swing the cone to throw the ring member into the air and to throw the ball also. An attempt might also be made as seen in FIG. 3 to throw the ball through the ring.

Although the preferred embodiment of the present invention has been described in specific terms, it is understood that there are many changes, modifications and additions which may be made therein without departing from the spirit and scope of the invention.

What is claimed is:

1. A game device and set comprising main base means adapted for being held by a player, first throwable token member means constructed for being thrown into the air from said main base means, second throwable token member means constructed for being thrown into the air by a player of the game, said main base means comprising a truncated cone body, and a brim portion formed at the wider end of said cone body and extending therefrom for being grasped by the hand of the player, said first throwable token member means comprising an annular ring member of light weight material having an inside diameter less than the widest diameter of said cone body so that in rest position on said cone body it rests above said brim portion, said second throwable token member means comprising a spherical ball, retaining string means secured at one end to said ball for returning said ball after being thrown, and finger ring holding means at the other end of said string means for engaging with a finger of the player's hand to be retained for retrieving said ball.

2. A game device and set in accordance with claim 1, wherein said main base means comprises said truncated cone body, said cone body being hollow and formed of sheet material, so that it allows the player to either grasp it by said brim portion, and otherwise to extend his hand and arm through the hollow cone for throwing said annular ring member and throwing said ball in playing said game.

* * * * *